United States Patent [19]

Okuda et al.

[11] Patent Number: 4,963,200

[45] Date of Patent: Oct. 16, 1990

[54] DISPERSION STRENGTHENED FERRITIC STEEL FOR HIGH TEMPERATURE STRUCTURAL USE

[75] Inventors: Takanari Okuda; Shigeo Nomura; Itaru Shibahara; Yuji Enokido, all of Mito; Masayuki Fujiwara; Toshio Nishida; Hiroshi Teranishi, all of Kobe; Susumu Hirano, Amagasaki; Aturou Iseda; Motoharu Nakajima, both of Nishinomiya, all of Japan

[73] Assignees: Doryokuro Kakunenryo Kaihatsu Jigyodan, Tokyo; Kobe Steel, Ltd., Hyogo; Sumitomo Metal Industries, Ltd., Osaka, all of Japan

[21] Appl. No.: 338,932

[22] Filed: Apr. 11, 1989

[30] Foreign Application Priority Data

Apr. 25, 1988 [JP] Japan ..... 63-102298
May 11, 1988 [JP] Japan ..... 63-114060

[51] Int. Cl.[5] ..... C22C 38/22
[52] U.S. Cl. ..... 148/325; 148/326
[58] Field of Search ..... 148/325, 326; 420/67; 376/339, 900

[56] References Cited

U.S. PATENT DOCUMENTS 3,660,173 5/1972 Matsuno et al. ..... 148/325

FOREIGN PATENT DOCUMENTS 3207276 10/1982 Fed. Rep. of Germany ..... 148/325
53-62720 6/1978 Japan ..... 148/325

OTHER PUBLICATIONS

Huet, J. et al, "Dispersion-Strengthened Ferritic Steels as Fast-Reactor Structural Materials" Nuclear Technology vol. 24, Nov. 1974, 420/68.

*Primary Examiner*—Deborah Yee
*Attorney, Agent, or Firm*—Wenderoth, Lind & Ponack

[57] ABSTRACT

A dispersion strenghened ferritic steel having excellent ductility and toughness which has been heat treated to produce a matrix having a tempered martensitic structure composed of 0.05 to 0.25% by weight of carbon, 0.1% by weight or less of silicon , 0.1% by weight or less of manganese, 8 to 12% by weight of chromium, 0.1 to 4.0% by weight in total of molybdenum and tungsten, and 0.02% by weight or less of oxygen (exclusive of oxide particles) with the balance being iron and inevitable impurities and, homogeneously dispersed in the matrix, composite oxide particles comprising $Y_2O_3$ and $TiO_2$ in an amount of 0.1 to 1.0% by weight in total of $Y_2O_3$ and $TiO_2$ and a $TiO_2$ to $Y_2O_3$ molar ratio of 0.5 to 2.0.

4 Claims, No Drawings

DISPERSION STRENGTHENED FERRITIC STEEL FOR HIGH TEMPERATURE STRUCTURAL USE

BACKGROUND OF THE INVENTION

The present invention relates to a dispersion strengthened ferritic steel for high temperature structural use which has excellent high temperature strength, ductility and toughness, and a reduced strength anisotropy.

The dispersion strengthened ferritic steel of the present invention is not only suitable as a core member of a nuclear reactor, particularly a fast breeder reactor but also can be advantageously utilized as a high temperature member of structures of equipment, e.g., piping members of a cooling system and boiler tubes, used under severe temperature and service conditions.

An example of the high temperature member, i.e., a material used as a core member of a nuclear reactor, particularly a fast breeder reactor is required to have various characteristics such as high temperature strength, compatibility with sodium, resistance to neutron radiation, workability, weldability, and interaction between the member and nuclear fuel. In particular, the high temperature strength and the resistance to neutron radiation are important factors in determining the service life.

Although an austenitic stainless steel, such as SUS 304 or 316, has hitherto been used as a reactor core member, it is known that this material has limited resistance to fast neutron, such as swelling resistance and irradiation creep characteristics, and therefore is unsuitable for prolonging the service life of nuclear fuel.

On the other hand, although the ferritic steel exhibits irradiation resistance far superior to that of the austenitic stainless steel, it is disadvantageously low in the high temperature strength. Dispersion strengthening with fine oxide particles is known for long as a method of improving the high temperature strength. Examples of the ferritic steel produced by this method are disclosed in a prior art reference, U.S. Pat. No. 4075010 entitled "Dispersion-strengthened ferritic alloy for use in liquid-metal fast breeder reactors (LMFBRS)". (The alloy disclosed in the U.S. Patent is hereinafter referred to as "the prior art alloy".)

Although the prior art alloy has high strength, it has low ductility and a ductile-brittle transient temperature as high as about 20° C, i.e., exhibits a very low impact value at room temperature, which brings about cracking even when the percentage cold rolling is as low as about ten-odd %. Therefore, it is difficult to economically produce from the prior art alloy core members of a fast breeder reactor, e.g., thin-wall pipes such as a fuel chadding tube or a wrapper tube which should be prepared with high dimensional accuracy. Further, the prior art alloy is a low ductility material which causes the cracks to be very easily propagated at a service temperature of the fast breeder reactor, i.e., 350° to 700° C. In other words, this alloy exhibits no advantages inherent in the dispersion strengthened material.

The dispersion strengthened ferritic steel has a problem of the so-called anisotropy of the strength that the strength in the direction perpendicular to the direction of working is $\frac{1}{2}$ to $\frac{1}{3}$ of the strength in the direction parallel to the direction of the working due to elongation of grains in the direction of working.

SUMMARY OF THE INVENTION

An object of the present invention is to provide a dispersion strengthened ferritic steel for high temperature structural use which has excellent high temperature strength, ductility and toughness, and a reduced anisotropy of strength as well.

According to the present invention, there is provided a dispersion strengthened ferritic steel which has been treated to produce tempered martensitic structure, and composite oxide particles homogeneously dispersed in the matrix.

The material is composed of 0.05 to 0.25% by weight of carbon, 0.1% by weight or less of silicon, 0.1% by weight or less of manganese, 8 to 12% by weight of chromium, 0.1 to 4.0% by weight in total of molybdenum and tungsten, and 0.02% by weight or less of oxygen (exclusive of oxide particles) with the balance being iron and inevitable impruities.

The composite oxide particles comprise $Y_2O_3$ and $TiO_2$ and are dispersed in the base material in an amount of 0.1 to 1.0% by weight in total of $Y_2O_3$ and $TiO_2$ and a $TiO_2$ to $Y_2O_3$ molar ratio of 0.5 to 2.0.

In the dispersion strengthened ferritic steel of the present invention, instead of or in addition to $TiO_2$, at least one powdery oxide selected from among Al2O3, ZrO2 and MgO may be dispersed, if required, in an amount of 0.1 to 1.0% by weight in total inclusive of $Y_2O_3$ and a molar ratio of 0.5 to 2.0 relative to $Y_2O_3$.

DETAILED DESCRIPTION OF THE INVENTION

The chemical components of the dispersion strengthened ferritic steel of the present invention and reasons for the limitation of these components will now be described. All percentage compositions described hereinbelow are given in weight percent.

Among the components, the presence of $Y_2O_3$ and $TiO_2$ is the first and the most important feature of the present invention.

$Y_2O_3$ is the most important component effective in improving the creep rupture strength through homogeneous dispersion in a base material. However, the sole use of $Y_2O_3$ is apt to bring about formation of a composite oxide through a combination with small amounts of silicon and manganese present in the form of a solid solution in the base material to thereby give rise to coarse oxide particles. Further, since $Y_2O_3$ particle itself is poor in the coherency with the base material, the addition of a large amount of $Y_2O_3$ cannot bring about any improvement in the creep rupture strength but rather harms the ductility and toughness.

A high creep rupture strength can be attained only when a stable composite oxide comprising $Y_2O_3$ and $TiO_2$, i.e., $Y_2O_3.TiO_2$is formed. The composite oxide $Y_2O_3.TiO_2$, i.e., $Y_2TiO_5$, can be formed by adding fine powders of $TiO_2$ in the process of mechanically mixing powders of a base alloy composition with powders of $Y_2O_3$. Since $Y_2O_3.TiO_2$ is more stable than $Y_2O_3$ energetically, all of the powders of $Y_2O_3$ and $TiO_2$ react with each other when mixed. It is also possible to use a preliminary prepared $Y_2O_3.TiO_2$ composite oxide.

In the above-described U.S. Pat. No. 4075010, there is a description reading: "The yttria ($Y_2O_3$) may combine with other components in the composition, such as titanium values to form phases such as $Y_2Ti_2O_7$." However, in this method, titanium presents in the form of a solid solution in the base material, and the titanium and $Y_2O_3$ particles react with each other to form a composite oxide, which renders the composition of the composite oxide heterogeneous, i.e., renders the titanium concentration of the composite oxide excessively high or low. Since this kind of oxide is thermally unstable, the particles thereof agglomerate to grow into a large size, when treated for softening at a high temperature during, for example, the process of manufacturing a tube. Such oxide particles grown into a large size bring about a lowering in the creep rupture strength. Further, excessive titanium remaining unreacted with $Y_2O_3$ precipitates in the form of a simple oxide, i.e., $TiO_2$. $TiO_2$ particles are apt to grow large during the use at a high temperature, thus lowering the ductility. Once the oxide particles grew into a large size, they will not be broken even when annealed for softening at a high temperature, so that the ductility of the alloy cannot be recovered.

In the present invention, a composite oxide which is stable and excellent in the compatibility with the material matrix can be homogeneously dispersed through a reaction of $Y_2O_3$ with $TiO_2$ in a molar ratio of 0.5 to 2.0. Further, since a stable composite oxide is formed because of participation of the whole of the added $TiO_2$ and $Y_2O_3$ in the reaction, the ductility is restored to a value before working through annealing for softening at a high temperature. The amount of $(Y_2O_3+TiO_2)$ should be at least 0.1% for the purpose of improving the high temperature strength. Although increasing the amount of addition of $(Y_2O_3+TiO_2)$ brings about an increase in the creep rupture strength, the upper limit of the amount of addition is 1% since the effect is saturated when the amount of addition reaches 1%.

The second feature of the present invention resides in the introduction of a martensitic structure for the purpose of reducing the anisotropy.

Since the dispersion strengthened ferritic steel is generally produced through a powder metallurgy process, there occurs anisotropy of the material in the processes of extrusion and rolling following the process of sintering. The anisotropy is attributable to elongation of grains in the direction of working (extrusion and rolling) and intended to mean that there occurs a large difference in the material characteristics between the direction parallel to that of working and the direction perpendicular to that of working.

For example, the dispersion strengthened ferritic steel of the prior art alloy has such an anisotropy that the high temperature creep rupture strength in the direction perpendicular to that of working is about $\frac{1}{3}$ of the one in the direction parallel to that of working. Since a fuel cladding tube is a long pipe having a small diameter, working is conducted to a great extent in the longitudinal direction thereof. Therefore, when the alloy has a ferritic single-phase structure, the anisotropy of the material becomes very large, which renders the internal pressure creep strength low, i.e., renders the resistance to hoop stress low.

By contrast, in the steel of the present invention, since the chromium content is limited to 8 to 12%, the anisotropy can be reduced through utilization of martensitic transformation. Specifically, since the martensitic structure produced by heat treatment for hardening does not depend on the direction of working, it becomes possible to convert the structure elongated towards the longitudinal direction into a non-oriented structure. Further, it is also possible to prepare a material having toughness higher than that of ferritic steel through application of proper heat treatment for tempering. In addition, an improvement in the creep rupture strength as well can be expected through interaction between the dislocation introduced by the martensitic transformation and the dispersed particles. For the above-described reasons, a proper chromium content is 12% or less from the viewpoint of stabilizing the martensitic structure. When the chromium content exceeds 12% there occurs 475° C brittleness and $\alpha$ brittleness due to an increase in the $\delta$-ferrite phase, which causes the strength and the toughness to be remarkably spoiled. Further, chromium is an element indispensable for improving the corrosion reistance and the decarburization resistance in sodium at a high temperature (600° to 700° C), and no resistance can be expected when the chromium content is less than 8%. For this reason, the chromium content is limited to 8 to 12%.

The functions of other additive components and the reasons for the limitation of amount thereof will no be described below.

Carbon:

Carbon is an austenite stabilizing element and stabilizes the martensitic structure. In the present invention wherein the chromium content is 8 to 12%, the lower limit of the carbon content is 0.05% in order to form a structure comprising a stable tempered martensitic single phase. When the carbon content is less than 0.05%, the strength and toughness are remarkably spoiled due to an increase in the $\delta$-ferrite phase. Further, carbon combines with alloying elements, i.e., niobium, vanadium, chromium, etc. to form a fine carbide, which contributes to an improvement in the creep rupture strength.

On the other hand, when the carbon content exceeds 0.25%, the amount of precipitation of carbide is increased, which spoils the workability and weldability accompanying the hardening of the steel. For this reason, the carbon content is limited to 0.05 to 0.25%.

Silicon:

Silicon is added as a deoxidizer of a melting stock for a mother alloy powder. When the silicon content is excessively large, it reacts with $Y_2O_3$ to form coarse silicon oxide, which not only brings about embrittlement during heating at a high temperature but also spoils the surface appearance. For this reason, the silicon content is limited to 0.1% or less.

Manganese:

Manganese serves as a deoxidizer and a desulfurising agent of a melting stock for a mother alloy powder and is added for improving the hot workability and stabilizing the structure. However, the addition of manganese in an excessively large amount brings about formation of a hardened phase, which spoils the toughness and workability and retards the uniform dispersion of the oxide. For this reason, the manganese content is limited to 0.1% or less.

Molybdenum and tungsten:

Molybdenum and tungsten are each a solid-soultion strengthening element and, at the same time, contribute to an improvement in the creep strength as elements constituting an intermetallic compound. When the (Mo+W) content is less than 0.1%, none of the above-described effects can be attained. On the other hand, when the (Mo+W) content exceeds 4.0%, not only the toughness is spoiled due to an increase in the $\delta$-ferrite phase but also there occurs embrittlement due to the precipitation of a large amount of an intermetallic compound during heating at a high temperature. Therefore, the (Mo+W) content is limited to 0.1to 4.0%.

Oxygen:

Oxygen is inevitably contained in a small amount due to adsorption on a raw powder or by oxidation. When the oxygen content exceeds 0.02%, not only the toughness is remarkably lowered but also oxygen is apt to combine with small amounts of silicon and manganese to form an inclusion. Therefore, the upper limit of the oxygen is 0.02%.

As described hereinbefore, in the dispersion-strengthened ferritic steel of the present invention, $TiO_2$ is used as oxide particle together with $Y_2O_3$. In the embodiments of the present invention, however, at least one powdery oxide selected from among $Al_2O_3$, $ZrO_2$ and MgO may be used instead of or in addition to $TiO_2$. Like $TiO_2$, these oxides react with $Y_2O_3$ to form a stable composite oxide and is uniformly dispersed in a material matrix, which contributes to an improvement in the creep strength. The above-described effect cannot be attained when the oxide content is less than 0.1% in terms of total oxide content and the molar ratio relative to $Y_2O_3$ is less than 0.5. When, on the other hand, the total oxide content exceeds 1.0% and the molar ratio relative to $Y_2O_3$ exceeds 2.0, they exert an adverse effect on the ductility, toughness, and workability. Therefore, the proper total oxide content and the proper molar ratio relative to $Y_2O_3$ are 0.1 to 1.0% and 0.5 to 2.0, respectively.

In the case where the oxide particles of $Al_2O_3$, $ZrO_2$ and/or MgO are used together with $Y_2O_3$ and homogeneously dispersed in the base material, the ferritic steel of the present invention may include, if required, at least one element selected from among 0.1 to 1.0% of nickel, 0.01 to 0.08% of nitrogen, and 0.001 to 0.1% of boron, 0.05 to 0.3% in total of at least one element selected from among zirconium, lanthanum, cerium and calcium, and 0.1 to 0.4% of vanadium and/or 0.01 to 0.2% of niobium.

The functions of these optional components and the reasons for the limitation of amount thereof will be described below.

Nickel:

Nickel is an austenite stabilizing element and serves as a component for stabilizing the martensitic structure. Nickel is added in an amount of at least 0.1% when the strength, toughness, and workability are to be imparted through controlling the amount of the δ-ferrite phase. When, however, the nickel content exceeds 1%, not only the creep strength is spoiled but also the heat treatment efficiency and workability are spoiled due to an excessive lowering in the transformation temperature. Therefore, the nickel content is limited to 0.1 to 1%.

Nitrogen:

Nitrogen combines with vanadium and niobium to form a nitride, which contributes to an improvement in the creep strength. However, no effect can be attained when the nitrogen content is less than 0.01%. On the other hand, when the nitrogen content exceeds 0.08%, the workability, toughness, and weldability are lowered. Therefore, a proper content of nitrogen is 0.01 to 0.08%.

Boron:

The addition of boron in a small amount contributes to an improvement in the creep strength through dispersion and stabilization of carbides. No effect can be attained when the boron content is less than 0.001%. On the other hand, when the boron content exceeds 0.01%, the workability and weldability are lowered. Therefore, a proper content of boron is 0.001 to 0.01%.

Zirconium, lanthanum, cerium, and calcium:

The addition of small amounts of these elements alone or in the form of a combination thereof is effective in removing phosphorus and sulfur contained in the impurities detrimental to toughness and controlling of inclusions. When the total content of these elements is less than 0.05%, the above-described effects cannot be attained. On the other hand, when the total content exceeds 0.3%, they exert an adverse effect on the toughness and workability. Therefore, a proper total content of these elements is 0.05 to 0.3%.

Vanadium:

Vanadium combines with carbon and nitrogen to form a fine precipitate comprising V(C, N), which not only contributes to an improvement in the creep strength but also controls the dispersion of the oxide. When the vanadium content is less than 0.1%, no sufficient effect can be attained, while when it exceeds 0.4%, the strength is spoiled. Therefore, the vanadium content is limited to 0.1 to 0.4%.

Niobium:

Like vanadium, niobium combines with carbon and nitrogen to form a fine precipitate comprising Nb(C, N), which not only contributes to an improvement in the creep strength but also controls the dispersion of the oxide. Further, niobium is useful also for improving the toughness through formation of a fine structure. When the niobium content is less than 0.01%, no effect can be attained. On the other hand, when the content exceeds 0.2%, a large amount of precipitates cannot be solved in matrix during heat treatment, which spoil the creep strength. Therefore, the niobium content is limited to 0.01 to 0.2%.

EXAMPLES

The present invention will now be described with reference to the following Examples.

Chemical compositions of the test materials are shown in Table 1.

In Table 1, steel species Nos. 1 and 2 belong to steel (I) claimed in claim 1 of the present invention, steel species Nos. 3 to 6 belong to steel (II) claimed in claim 2 of the present invention, and steel species Nos. 7 to 12 belong to steel (III) claimed in claim 3 of the present invention. Steel species Nos. 13 to 17 are reference steels wherein the contents of important constituent components, i.e., chromium and (Mo +W), are outside the range specified in the present invention or titanium is employed instead of $TiO_2$. Among them, steel species No. 17 corresponds to the prior art alloy proposed in U.S. Pat. No. 4075010.

With respect to each steel, element powders or alloy powders each having a mean particle diameter of 1 μm or less are mixed with oxide powders each having a mean particle diameter of 1000 Åor less so as to have an intended composition. The mixture was put into a high-energy attritor and mechanically alloyed while agitating in a high-purity argon atmosphere. The number of revolutions of the attritor and the agitation time were 200 to 300 rpm and 24 to 48 hr, respectively. The resultant alloy powder was vacuum sealed into a SUS tubular container without exposure to the air and subjected to hot extrusion at 900° to 1200° C in an extrusion ratio of 8 to 15:1.

Each hot extruded rod like material was forged into a plate like material having a thickness of 10 mm and then normalized at 950° to 1200° C. After normalization, all of the steels except for steel species Nos. 14 and 17 were heat treated for tempering at 750° to 820° C to prepare the test materials.

Sheet like tensile test pieces each having a size of 2 mm thickness × 6 mm width × 30 mm length were prepared from the test materials and subjected to a creep rupture test at 650° C and a tensile test at room temperature. Further, test pieces for a Charpy impact test each having a size of 5 mm thickness 10 mm width × 55 mm length (2 mm V notched) were prepared and subjected to examination of impact characteristics. Further, a 10 mm-thick sheet like material was cold rolled by 20% and then aged at 700° C for 100 hr. Sheet like test pieces each having a size of 2 mm thickness × 6 mm width x 30 mm length were prepared from the aged test material along the direction of rolling (longitudinal direction) and the direction perpendicular thereto (transverse direction) and subjected to a tensile test at room temperature to examine the tensile ductility.

The test results are summarized in Table 2. It is apparent form Table 2 that steel Nos. (I), (II), and (III) of the present invention are superior to the reference steels in the creep rupture stress at 650° C for $10^3$ hr, tensile elongation at room temperature and 650° C, and Charpy impact values at 20° C.

Further, it is apparent that the anisotropy of the material is small by virtue of a high strength in the transverse direction as well.

As described above, the present invention enables production of an oxide dispersion strengthened ferritic steel exhibiting excellent high temperature strength for a long term period, small anisotropy, and excellent ductility and toughness, which makes it possible to achieve the long-life service of heat resistant components, i.e., a structural component used at a high temperature under a high pressure.

While the present invention has been described with respect to specific embodiments, it should be apparent to those skilled in the art that numerous modifications may be made thereto without departing from the scope of the invention.

TABLE 1

| | Chemical Compositions of Test Material (wt %) | | | | | | | | | | | | | | | |
|---|---|---|---|---|---|---|---|---|---|---|---|---|---|---|---|---|
| No. | C | Si | Mn | Ni | Cr | Mo | W | V | Nb | N | O | $Y_2O_3$ | $TiO_2$ | Fe & Impurities | Others | Remarks |
| 1 | 0.13 | 0.05 | 0.03 | — | 11.1 | 1.0 | 1.1 | — | — | 0.04 | 0.016 | 0.26 | 0.09 | balance | — | Steel (I) of the present invention |
| 2 | 0.11 | 0.02 | 0.05 | — | 10.9 | 0.6 | 1.5 | — | — | 0.03 | 0.015 | 0.33 | 0.11 | balance | — | |
| 3 | 0.06 | 0.02 | 0.09 | — | 10.0 | 2.2 | 0.2 | — | — | 0.02 | 0.012 | 0.38 | — | balance | $ZrO_2 + Al_2O_3$:0.20 | Steel (II) of the present invention |
| 4 | 0.15 | 0.08 | 0.07 | — | 11.0 | 0.6 | 1.4 | 0.24 | — | 0.04 | 0.010 | 0.39 | — | balance | $ZrO_2$ + MgO:0.33 | |
| 5 | 0.11 | 0.08 | 0.07 | — | 11.6 | 0.2 | 1.6 | 0.20 | 0.06 | 0.03 | 0.014 | 0.41 | 0.11 | balance | $Al_2O_3$ + MgO:0.31 | |
| 6 | 0.11 | 0.03 | 0.05 | — | 11.2 | 0.5 | 1.3 | — | — | 0.02 | 0.018 | 0.38 | 0.18 | balance | $ZrO_2$:0.24 | |
| 7 | 0.15 | 0.05 | 0.08 | — | 11.3 | 0.2 | 2.6 | — | 0.12 | 0.02 | 0.011 | 0.46 | 0.15 | balance | B:0.015 | Steel (III) of the present invention |
| 8 | 0.08 | 0.05 | 0.06 | 0.81 | 11.1 | — | 3.0 | — | 0.13 | 0.03 | 0.013 | 0.35 | 0.12 | balance | B:0.010<br>La + Ce:0.013 | |
| 9 | 0.11 | 0.04 | 0.05 | — | 10.8 | 1.2 | 2.8 | 0.56 | 0.08 | 0.03 | 0.009 | 0.43 | 0.15 | balance | Ti:0.08<br>La + Ce:0.021 | |
| 10 | 0.19 | 0.02 | 0.06 | — | 11.1 | 0.4 | 3.1 | 0.38 | — | 0.03 | 0.012 | 0.3 | 0.09 | balance | Ca:0.005<br>Zr:0.17 | |
| 11 | 0.17 | 0.04 | 0.05 | 0.34 | 11.2 | 0.3 | 2.6 | — | 0.11 | 0.03 | 0.017 | 0.32 | 0.10 | balance | $ZrO_2 + Al_2O_3$:0.25<br>B:0.018 | |
| 12 | 0.20 | 0.02 | 0.07 | — | 10.2 | — | 2.7 | — | 0.10 | 0.03 | 0.016 | 0.41 | 0.14 | balance | $ZrO_2$ + MgO:0.13<br>B:0.010, Zr:0.11 | |
| 13 | 0.18 | 0.12 | 0.04 | 0.25 | 9.3 | — | — | 0.26 | — | 0.01 | 0.147 | 0.42 | — | balance | — | Reference Steels |
| 14 | 0.07 | 0.05 | 0.06 | — | 15.6 | — | — | — | — | 0.09 | 0.112 | 0.46 | — | balance | Al:4.35 | |
| 15 | 0.08 | 0.08 | 0.06 | — | 13.6 | 1.2 | — | — | — | 0.13 | 0.053 | 0.47 | — | balance | — | |
| 16 | 0.09 | 0.06 | 0.05 | 0.46 | 11.1 | — | — | 0.27 | — | 0.12 | 0.071 | 0.51 | — | balance | — | |
| 17 | 0.013 | 0.04 | 0.04 | 0.45 | 13.8 | 0.3 | — | — | — | 0.12 | 0.026 | 0.27 | — | balance | Ti:0.95 | |

TABLE 2

| | Comparison on Creep rupture strength, Ductility and Toughness | | | | | |
|---|---|---|---|---|---|---|
| | | Creep rupture strength at 650° C. for $10^3$ kgf/mm | | Tensile elongation at room temp. of aged material (%) | Tensile elongation at 650° C. of aged material (%) | Charpy impact value at 20° C. kgf-m/cm$^2$) |
| Steel species No. | | Longitudianl direction | Transverse direction | | | |
| Steel (I) of the present invention | 1 | 35.1 | 30.8 | 18.2 | 45.8 | 25.3 |
| | 2 | 34.2 | 31.7 | 20.5 | 44.3 | 24.7 |
| Steel (II) of the present invention | 3 | 35.0 | 31.3 | 19.3 | 47.0 | 19.8 |
| | 4 | 33.5 | 33.7 | 20.4 | 43.2 | 21.3 |
| | 5 | 32.4 | 31.0 | 18.6 | 44.5 | 22.5 |
| | 6 | 37.7 | 34.5 | 17.7 | 40.3 | 20.8 |
| Steel (III) of the present invention | 7 | 31.2 | 32.4 | 19.2 | 41.1 | 18.9 |
| | 8 | 34.5 | 31.8 | 25.3 | 39.8 | 20.5 |
| | 9 | 33.7 | 34.6 | 22.7 | 43.8 | 18.5 |
| | 10 | 32.2 | 30.1 | 17.6 | 42.5 | 22.3 |
| | 11 | 34.0 | 31.5 | 19.0 | 41.7 | 20.2 |
| | 12 | 34.5 | 32.2 | 19.3 | 43.0 | 18.6 |
| Reference steels | 13 | 10.6 | 9.3 | 15.0 | 38.9 | 8.9 |
| | 14 | 11.7 | 7.6 | 8.7 | 41.1 | 0.5 |
| | 15 | 18.4 | 9.9 | 7.6 | 33.6 | 1.6 |

TABLE 2-continued

| Steel species No. | Comparison on Creep rupture strength, Ductility and Toughness: Creep rupture strength at 650° C. for $10^3$ kgf/mm Longitudianl direction | Transverse direction | Tensile elongation at room temp. of aged material (%) | Tensile elongation at 650° C. of aged material (%) | Charpy impact value at 20° C. kgf-m/cm$^2$) |
|---|---|---|---|---|---|
| 16 | 20.5 | 8.7 | 16.3 | 19.8 | 10.1 |
| 17 | 33.4 | 10.5 | 9.6 | 16.3 | 5.6 |

What is claimed is:

1. A dispersion strengthened ferritic steel having excellent ductility and toughness, which has been heat treated to produce a matrix having a tempered martensitic structure comprising 0.05 to 0.25% by weight of carbon, 0.1 % by weight or less of silicon, 0.1% by weight or less of manganese, 8 to 12% by weight of chromium, 0.1 to 4.0 % by weight in total of molybdenum and tungsten, and 0.02% by weight or less of oxygen with the balance being iron and inevitable impurities and, homogeneously dispersed in said matrix, composite oxide particles comprising $Y_2O_3$ and at least one of $TiO_2$, $Al_2O_3$, $ZrO_2$ and MgO in an amount of 0.1 to 1.0% by weight in total inclusive of $Y_2O_3$ and the molar ratio of the total of said at least one of $TiO_2$, $Al_2O_3$, $ZrO_2$ and MgO is 0.5 to 2.0 relative to $Y_2O_3$.

2. The dispersion strengthened ferritic steel according to claim 1, wherein at least one of $Al_2O_3$, $ZrO_2$ and MgO is dispersed in said matrix in an amount of 0.1 to 1.0% by weight in total inclusive of $Y_2O_3$ and the molar ratio of the total of said at least one of $Al_2O_3$, $ZrO_2$ and MgO is 0.5 to 2.0 relative to $Y_2O_3$.

3. The dispersion strengthened ferritic steel according to claim 2, which further optionally comprises at least one member selected from among 0.1 to 1.0% by weight of nickel, 0.01 to 0.08% by weight of nitrogen, and 0.001 to 0.01% by weight of boron, 0.05 to 0.3% by weight in total of at least one member selected from among zirconium, lanthanum, cerium and calcium, and 0.1 to 0.4% by weight of vanadium and/or 0.01 to 0.2% by weight of niobium.

4. The dispersion strengthened ferritic steel according to claim 1 wherein $TiO_2$ is dispersed in said matrix in an amount of 0.1 to 1.0% by weight in total inclusive of $Y_2O_3$ and the molar ratio of $TiO_2$ is 0.5 to 2.0 relative to $Y_2O_3$.

* * * * *